US009541356B2

(12) United States Patent
Bullis

(10) Patent No.: US 9,541,356 B2
(45) Date of Patent: Jan. 10, 2017

(54) PORTABLE ROTARY TARGET APPARATUS

(71) Applicant: Steven James Bullis, White Bear Lake, MN (US)

(72) Inventor: Steven James Bullis, White Bear Lake, MN (US)

( * ) Notice: Subject to any disclaimer, the term of this patent is extended or adjusted under 35 U.S.C. 154(b) by 157 days.

(21) Appl. No.: 14/592,848

(22) Filed: Jan. 8, 2015

(65) Prior Publication Data

US 2016/0061570 A1 Mar. 3, 2016

Related U.S. Application Data

(60) Provisional application No. 62/042,309, filed on Aug. 27, 2014.

(51) Int. Cl.

| | |
|---|---|
| ***F41J 5/18*** | (2006.01) |
| ***F41J 1/10*** | (2006.01) |
| ***F41J 7/06*** | (2006.01) |
| ***F41J 13/02*** | (2009.01) |

(52) U.S. Cl.
CPC .. *F41J 5/18* (2013.01); *F41J 1/10* (2013.01); *F41J 7/06* (2013.01); *F41J 13/02* (2013.01)

(58) Field of Classification Search
CPC ..... F41J 5/18; F41J 1/10; F41J 7/06; F41J 13/02
USPC ..... 273/383, 448, 390, 354, 368, 331, 348.4,273/317.2, 366
See application file for complete search history.

(56) References Cited

U.S. PATENT DOCUMENTS

| | | | |
|---|---|---|---|
| 794,775 | A | 7/1905 | Bowerman |
| 3,794,318 | A | 2/1974 | Holmes |
| 5,765,832 | A | 6/1998 | Huff |
| 7,611,147 | B2 | 11/2009 | Sheldon |

FOREIGN PATENT DOCUMENTS

| | | |
|---|---|---|
| GB | 191016158 A | 3/1911 |
| GB | 19860026163 | 5/1988 |
| JP | 19920351801 | 6/1994 |

*Primary Examiner* — Aarti B Berdichevsky
*Assistant Examiner* — Christopher Glenn
(74) *Attorney, Agent, or Firm* — Berggren Law Offices, LLC; William R. Berggren; Stephen F. Wolf

(57) ABSTRACT

A portable rotary target apparatus that allows a person with a projectile device to improve their accuracy. The apparatus comprises at least one projectile actuated rotary target mechanism that comprises three elements, a rotary plate, a non-rotary pressure-actuated plate, and a portable frame attached to a constant tension device and a contacting device.

19 Claims, 9 Drawing Sheets

PORTABLE ROTARY TARGET APPARATUS

FIELD OF THE INVENTION

This invention relates to portable rotary target for use with projectile devices.

BACKGROUND OF THE INVENTION

There is an ongoing need for a portable target apparatus that allows a person with a projectile device to improve his or her aim.

People using projectile devices improve their aim through practice. Generally this practice takes the form of firing projectiles at stationary targets at gun ranges. Targets are frequently used one time but some may be used repeatedly. However, the target is generally replaced with one having smaller insignia if a more challenging target is desired.

Portable targets generally have the same limitations of achieving increasing challenging situations for a person with a projectile device.

There is still a need for a portable target apparatus that allows a person with a projectile device to improve his or her aim.

SUMMARY OF THE INVENTION

I have invented a portable rotary target apparatus and a method of using same that allows a person with a projectile apparatus to improve his or her accuracy. The apparatus comprises at least one projectile actuated rotary target mechanism that comprises three elements, a rotary plate, a non-rotary pressure-actuated plate, and a portable frame attached to a constant tension device and a contacting device. The rotary plate has a front face, a rear face, an axis of rotation with an axis rod, a first aperture having a size and displaced from the axis, at least a second aperture having a different size and displaced from the first aperture, and a stop associated with each aperture and located on the rear face. The rotary plate is able to rotate along its axis rod about an axis perpendicular to the frontal face. The non-rotary, pressure-actuated plate is proximate to the rear face of the rotary plate and has a rear face and a frontal face with an edge configured to contact the stop associated with each aperture to stop further rotation of the rotary plate. The pressure-actuated plate is made of a material configured to be resistant to penetration by impact of a projectile from a predetermined projectile device. The portable frame is in communication with the axis rod and anchors one end of a constant tension device that has its other end in communication with the axis rod. The portable frame also anchors one end of a contacting device configured to have its other end in contact the with the rear face of the pressure-actuated plate to urge the front face of the pressure-actuated plate to contact the rear face of the rotary plate. In operation, when the constant tension device is under tension and the pressure-actuated plate is pushed away from the rotary plate by an impact of a projectile, the rotary plate is able to rotate to the next stop and the aperture associated with that stop is now over the pressure-actuated plate.

The method of using a portable rotary target apparatus comprises five steps. The first step is providing a portable rotary target apparatus that comprises at least one projectile actuated rotary target mechanism as described above and a container encompassing the at least one projectile actuated rotary target mechanism, the container comprising a front surface offset from the rotary plate to permit collection of spent projectiles and having an aperture sized to be at least as large as the largest aperture on the rotary plate and positioned over the first aperture of the rotary place and the pressure-actuated plate. The second step is providing a projectile device having at least one projectile suitable for use with the apparatus. The third step is applying tension to the constant tension device and placing the apparatus at a desired location. The fourth step is impacting the visible portion of the pressure-actuated plate with the projectile. The fifth step is observing the rotation of the rotating plate from showing the first aperture of the rotary plate to showing the next aperture.

My invention is a simple, easy to use, portable target with a self-advancing selection of new targets that are sized differently. This permits a person to fire at targets of different sizes, often decreasing in size to practice his or her shooting. It also allows for the collection of spent projectiles when the practice session is completed.

Figure 1:
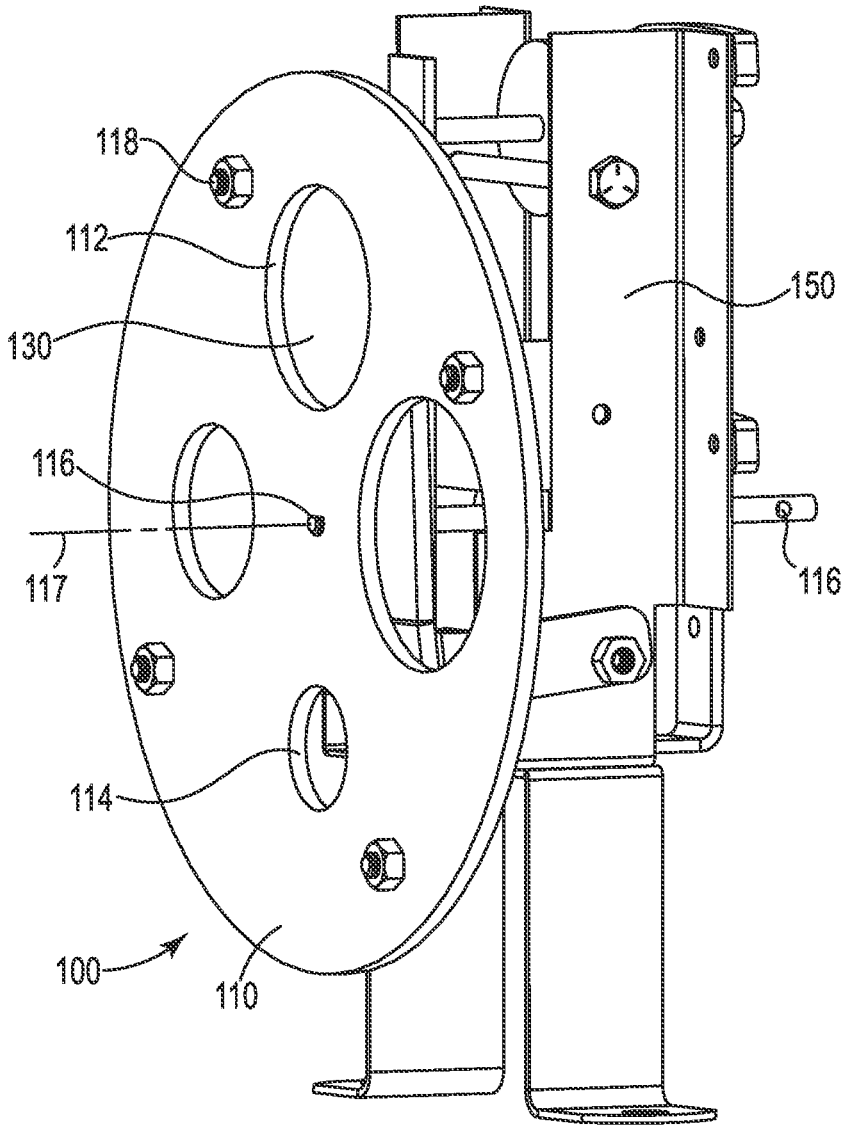
FIG. 1 illustrates a forward perspective view of an embodiment of the projectile actuated rotary target mechanism.

While the invention is amenable to various modifications and alternative forms, specifics have been shown by way of example in the drawings and will be described in detail below. It is to be understood, however, that the intention is not to limit the invention to the particular embodiments described. On the contrary, the invention is intended to cover all modifications, equivalents, and alternatives falling within the scope of the invention as defined by the appended claims.

DETAILED DESCRIPTION OF SOME EMBODIMENTS OF THE INVENTION

Projectile devices range from devices that propel relatively soft projectiles such as air soft and pellets to those that propel more sturdy projectiles such as powder impelled bullets. Devices may range from air soft guns and pellet guns to pistols, revolvers, and rifles. All require training in accuracy of placing the projectile on a target.

One problem is to be able to sharpen a marksman's aim to hit a target that shows increasing difficulty. Typically, current targets are often stationary ones that require the physical changing of the old target for a new target. Other targets are electronic and not suitable for extensive outdoor use.

I have invented a portable target to solve this problem. The target is not like other targets out there in the market place. When you shoot and hit the target hole it trips a contacting device, such as a tongue latch, that releases an axis rod turning a rotary plate with at least two apertures to its next position. In one embodiment, each time you hit the target hole it can get smaller—up to 4 separate apertures starting at a diameter of 2¾ inches then getting smaller by a half inch on every target hit to a fourth aperture of 1¼ inches. Then it is reset to its largest size and cycles again to its smallest size. You can make these holes bigger or smaller with sets of apertures to accommodate shooters ranging from inexperienced to proficient. This target actually makes you a better shot, and in one embodiment it repeatedly advances to the next aperture for up to over 140 times on one wind up of a constant tension device such as a tension spring mechanism. This is a portable target that can be wound-up to supply you with plenty of target hits before having to reset it. In one embodiment this target is also a pellet trap that you can tip forward and then the front lip bend acts as a funnel to recycle you lead back into a container to properly dispose of. This target also can use a disposable paper target frontal face.

Specifically, the invention is a portable rotary target apparatus and a method of using same that allows a person with a projectile apparatus to improve his or her accuracy. The apparatus comprises at least one projectile actuated rotary target mechanism that comprises three elements, a rotary plate, a non-rotary pressure-actuated plate, and a portable frame attached to a constant tension device and a contacting device.

The rotary plate has a front face, a rear face, an axis of rotation with an axis rod, a first aperture having a size and displaced from the axis, at least a second aperture having a different size and displaced from the first aperture, and a stop associated with each aperture and located on the rear face. The rotary plate is able to rotate along its axis rod about an axis perpendicular to the frontal face. Apertures may be of any shape, such as, for example, a circle, square, triangle, other polygon, or any irregular shape. In some embodiments, the apertures have varying sizes to offer increased challenges to a shooter. As mentioned above some embodiments may have rotary plates having a set of four apertures varying in size from, for example, 2¾ inches to 1¼ inches. Others may be designed for more proficient shooters and may have three apertures that start at, for example, 1½ inch and decrease by ½ increments to ½ inch. Of course the difficulty may also be enhanced by increasing the distance from the invention to the shooter.

The stops are affixed to the rotary plate to stop the rotary plate's rotation to the next aperture. Some embodiments use bolts to fasten screws to the back of the rotary plate. The screw heads are ground to result in a raised surface that is configured to catch the pressure-actuated plate at its next stop position upon release. Other stop configurations may be possible that perform the same function.

The non-rotary, pressure-actuated plate is proximate to the rear face of the rotary plate and has a rear face and a frontal face with an edge configured to contact the stop associated with each aperture to stop further rotation of the rotary plate. The pressure-actuated plate is made of a material configured to be resistant to penetration by impact of a projectile from a predetermined projectile device.

The portable frame is in communication with the axis rod and anchors one end of a constant tension device that has its other end in communication with the axis rod. One example of a constant tension device is a windup tension spring. Such a tension device has a handle attached to the axis rod to wind up the spring. Other devices are suitable as long as they provide the same function of advancing the rotary plate in a similar manner to its next aperture upon the release of the non-rotary pressure-actuated plate from the rotary plate when a colliding projectile momentarily pushes the non-rotating pressure-actuated plate away from the rotary plate as it engages the stop. Some embodiments have tension devices that permit rotation of the rotating plate of up to 10 complete rotations before the device needs to be reset, such as by winding it up in the case of a tension spring. Some embodiments have tension devices that permit at least twenty complete rotations, some at least thirty complete rotations, some at least forty complete rotations, the equivalent of 120 separate targets with embodiments that have four apertures on the rotating plate. The portable frame also anchors one end of a contacting device configured to have its other end in contact the with the rear face of the pressure-actuated plate to urge the front face of the pressure-actuated plate to contact the rear face of the rotary plate. Such a contacting device is, for example, a torque latch. Other contacting devices may be used as long as they provide the same function. In operation, when the constant tension device is under tension and the pressure-actuated plate is pushed away from the rotary plate by an impact of a projectile, the rotary plate is able to rotate to the next stop and the aperture associated with that stop is now over the pressure-actuated plate.

The portable target apparatus can further comprise a container encompassing the at least one projectile actuated rotary target mechanism. The container includes a front surface offset from the rotary plate to permit collection of spent projectiles and has an aperture sized to be at least as large as the largest aperture on the rotary plate and positioned over the first aperture of the rotary plate and the non-rotary pressure-actuated plate. Embodiments that are to be used outdoors are made of materials that durable under exposure to outdoor conditions. These include, metal, wood, and plastic. Some embodiments have containers made of 20 gauge metal for durability. Other thicknesses and materials may be used depending on the projectile device used and the locations contemplated. Some embodiments have a collection region below the front surface configured to be able to gather spent projectiles. Some embodiments have a front panel that is made of a material resistant to damage from collision of projectiles to protect the projectile actuated rotary target mechanism that is inside from damage. Some embodiments further comprise replaceable sheets that form target displays that overlay the front surface to present various target visualizations, such as, for example, a person's head, a target with concentric rings, and a geometric pattern. Some embodiments comprise containers that have a raised lip below the front face to gather spent projectiles for subsequent disposal. Some embodiments may have windows to show counters that measure revolutions of the rotary plate.

Embodiments of the portable rotary target apparatus of the invention also may comprise a container encompassing the at least two projectile actuated rotary target mechanism. These embodiments have on the front surface an aperture associated with each projectile actuated rotary target mechanism, sized to be at least as large as the largest aperture on the rotary plate, and positioned over the first aperture of the rotary plate and the non rotary pressure-actuated plate. Some embodiments may also comprise a front surface offset from the rotary plate to permit collection of spent projectiles. Some embodiments have a collection region below the front surface configured to be able to gather spent projectiles. In some embodiments containing at least two projectile actuated rotary target mechanism, the rotary plates have at least three apertures and a fourth colored region where a fourth aperture would have been located. Some of these embodiments have a pull cord mechanism as the tension device to reset all rotary plates to a position where the first aperture of each rotary plate is at a position showing the non rotary pressure-sensitive plate to permit a competitive game.

One such embodiment of the invention suitable for use in a game amount more than one shooters, may involve the following apparatus. A double wide box is used as a container with, a double face cover with 1.5 inch holes. A handle is used on a rope threaded thru two clips and half a wind on both existing spools. It is then sent out the left side of the box thru a ¼" pipe nipple to reset the tension device, a spring, for the mechanical mechanism after one revolution that it takes to finish the game. The rotary has four holes starting at 1.5 inch and decreasing to the smallest at ⅞ inch with 5 stop points, the last being a colored blank on the rotary plate signaling the winner.

The apparatus can also be taught by reference to figures depicting several embodiments described above.

FIG. 1 illustrates a forward perspective view of an embodiment of the projectile actuated rotary target mechanism (100). A rotary plate (110) in communication with a frame (150) through an axis rod (116) along an axis (117) is shown with a first aperture (112) and at least one other aperture (114) with a different size. A non rotary pressure-actuated plate (130) is seen through first aperture 112. Nuts (118) are shown securing stop screws shown in FIG. 2.

Figure 2:
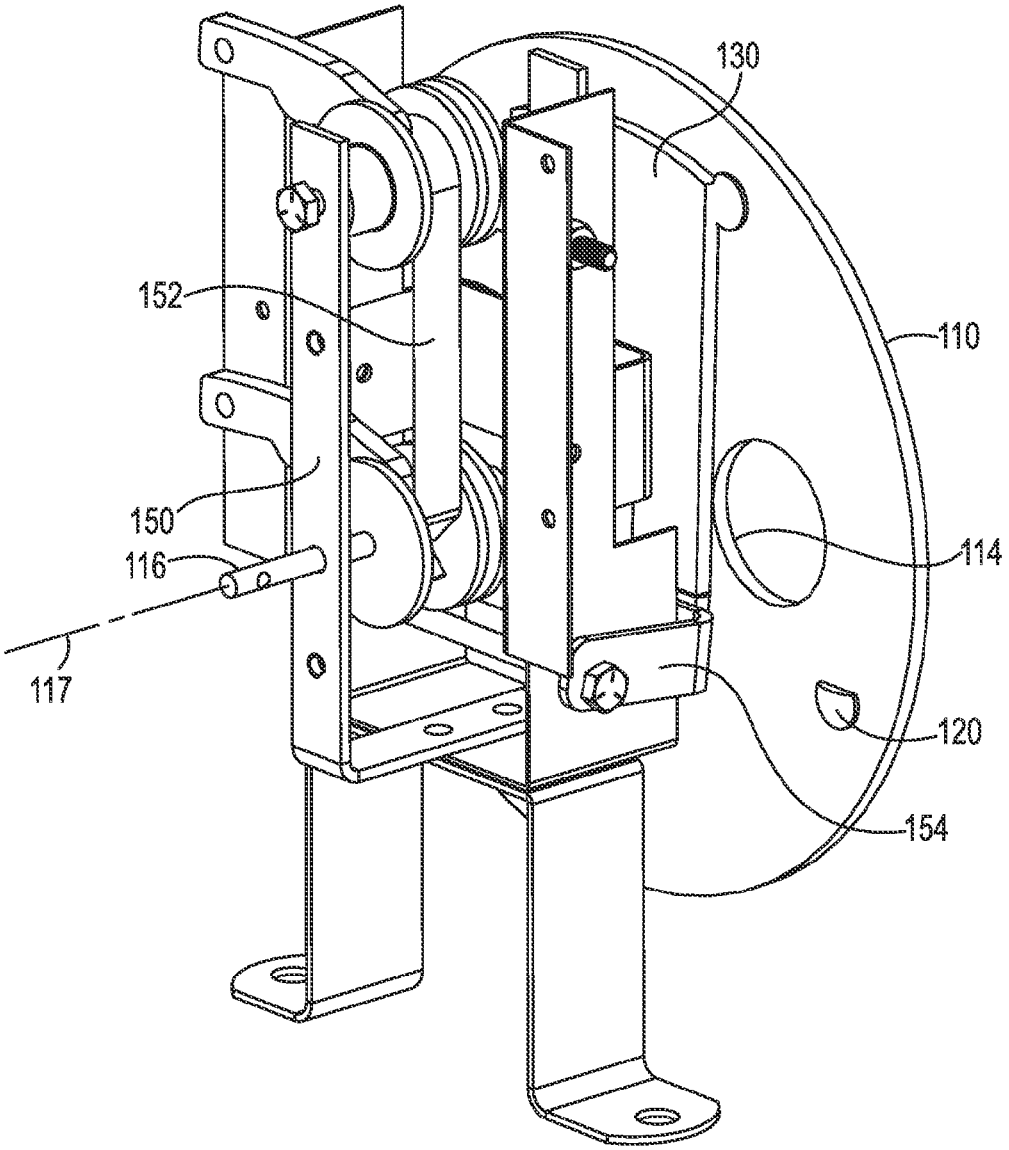
FIG. 2 illustrates a rearward perspective view of the embodiment shown in FIG. 1 of the projectile actuated rotary target mechanism.

FIG. 2 illustrates a rearward perspective view of the embodiment shown in FIG. 1 of the projectile actuated rotary target mechanism. Rotary plate 110 in communication with frame 150 through axis rod 116 alone axis 117 has aperture 114. Non rotary pressure-actuated plate 130 is shown covering the first aperture (not seen). Stop screws (120) are shown with one preventing rotation of rotary plate 110 by contacting non rotary pressure-actuated plate 130. A tension device (152), in this embodiment a wind up spring, is shown connected to frame 150 and axis rod 116. Contacting device (154), in this embodiment a torque latch, is shown contacting frame 150 and pressing into the back of pressure-actuated plate 130 to keep it in contact with rotary plate 110 so the stop will engage non rotary pressure-actuated late 130 after collision with a projectile momentarily dislodges it from rotary plate 112.

Figure 3:
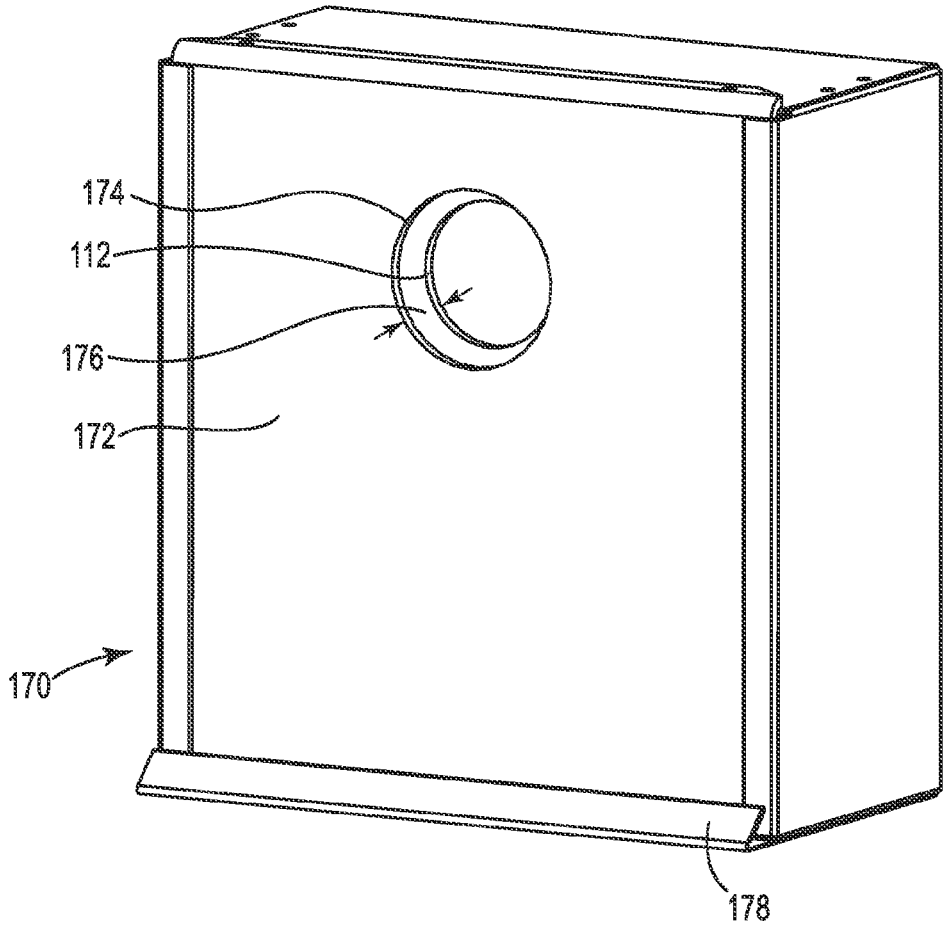
FIG. 3 illustrates a perspective view of an embodiment of the invention with a container.

FIG. 3 illustrates a perspective view of an embodiment of the invention with a container (170). A front surface (172) has an aperture (174) that is offset by a distance (176) from aperture 112 of rotary plate 110. A raised edge (178) is for collecting spent projectiles that drop down the inset space.

Figure 4:
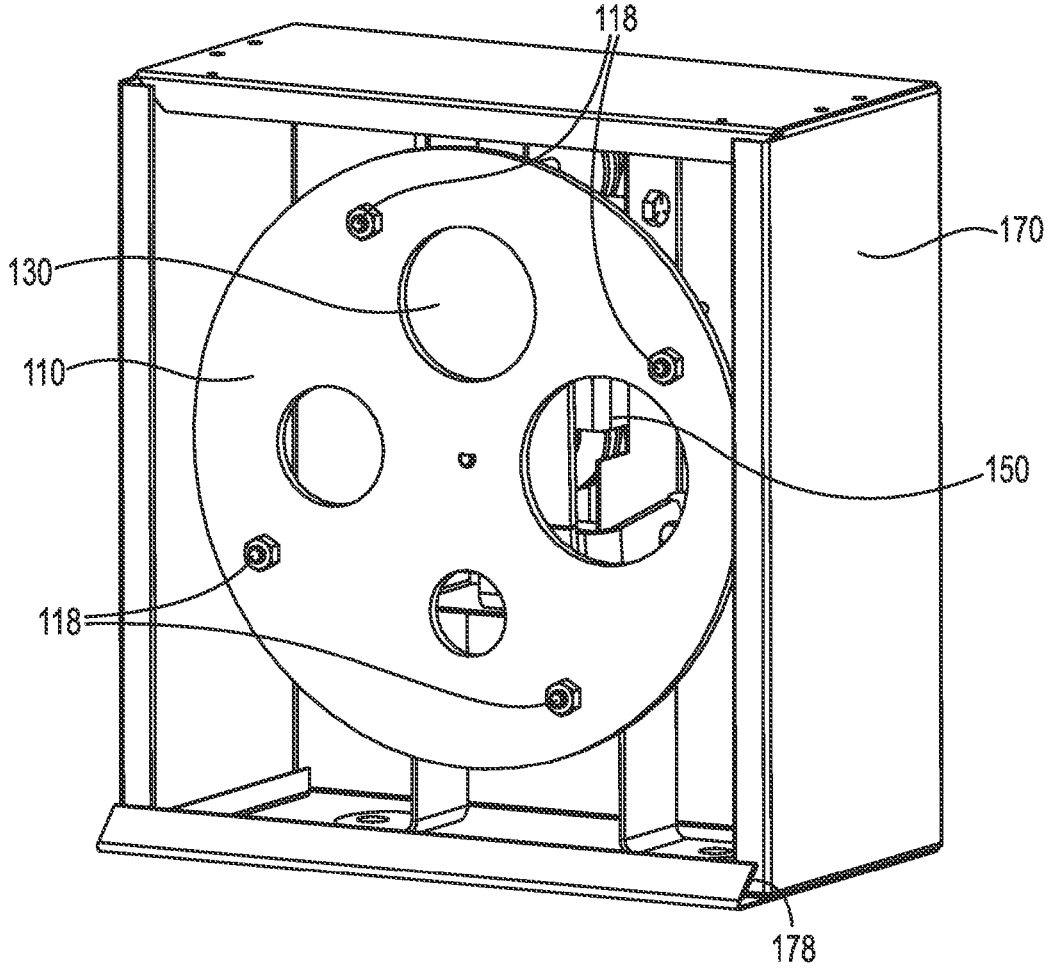
FIG. 4 illustrates a perspective view of the projectile actuated rotary target mechanism shown in FIG. 1 as it sits in a container without a front surface being shown.

FIG. 4 illustrates a perspective view of the projectile actuated rotary target mechanism shown in FIG. 1 as it sits in a container without a front surface shown. Non rotary pressure-actuated plate 130 is seen through the upper aperture of rotary plate 110 stop nuts 118 are displayed after each aperture on rotary plate 110. Container 170 is shown with bent lip 178 for collecting spent projectiles.

Figure 5:
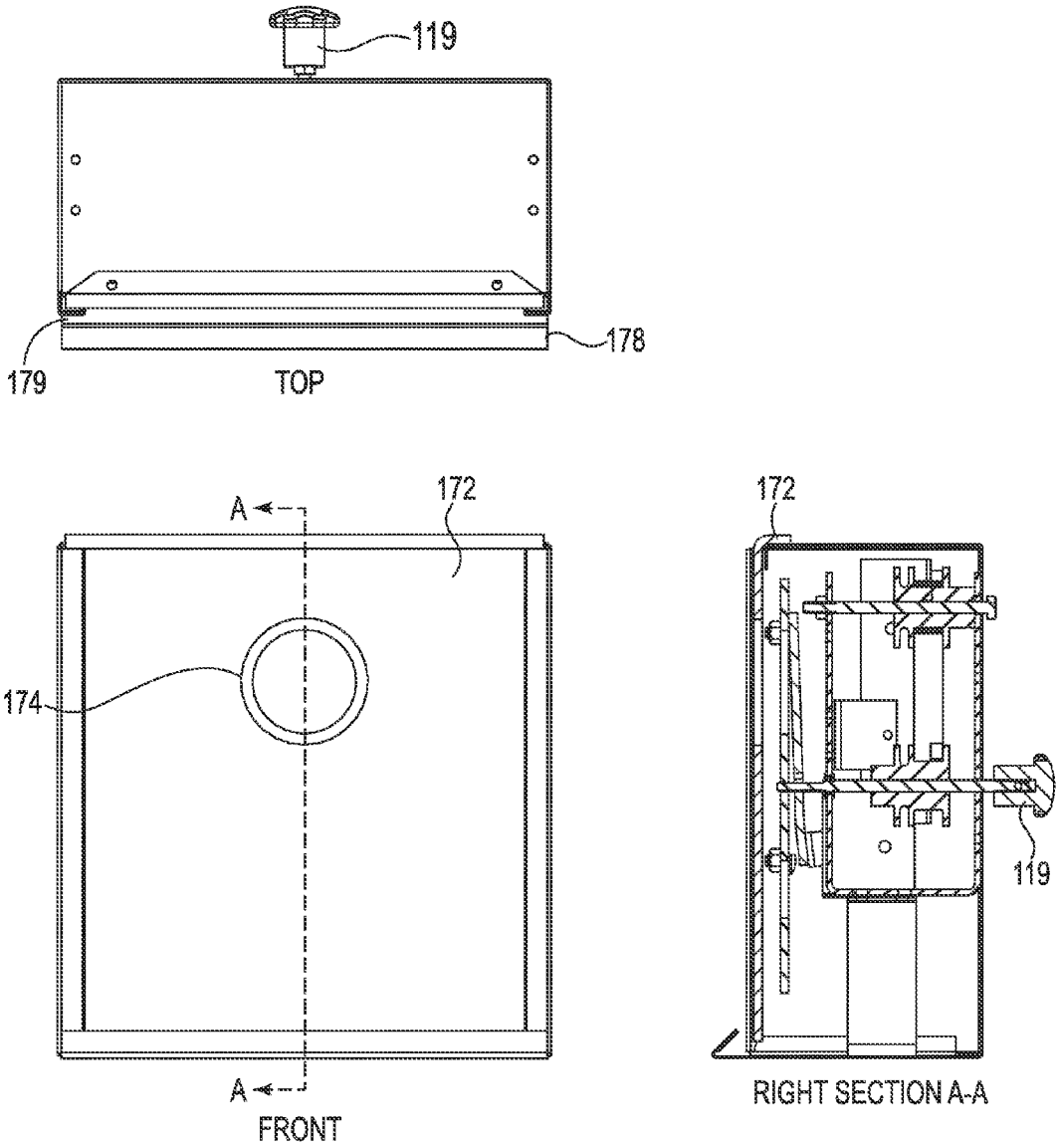
FIG. 5 illustrate front, top and side views of the embodiment of the invention shown in FIG. 3 an inside view of projectile actuated rotary target mechanism 100.

FIG. 5 illustrate front, top and side views of the embodiment of the invention shown in FIG. 3 with an inside view of projectile actuated rotary target mechanism 100. The top view and section A-A view shows a handle (179) attached to the axis rod to wind up the tension device before use of the apparatus. The top view also shows a disposable target sheet (179) inserted before front surface 172 of the container.

Figure 6:
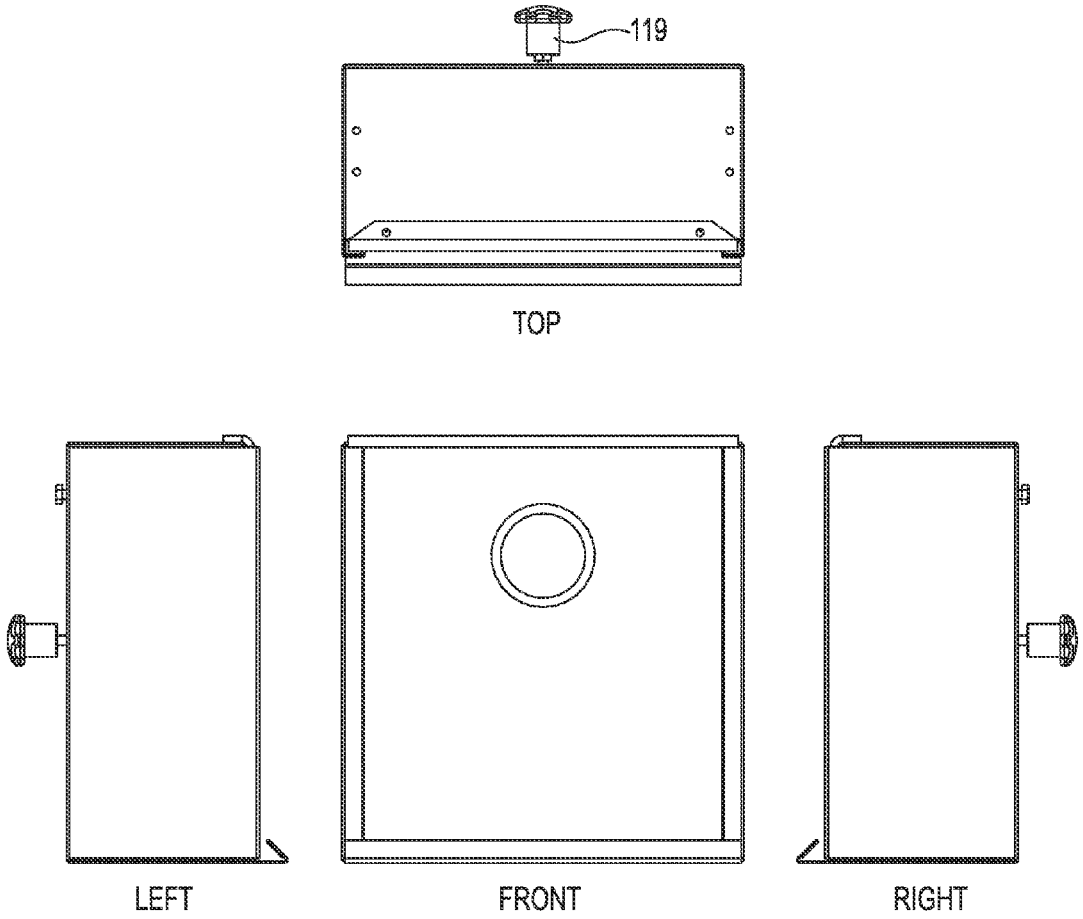
FIG. 6 illustrate front, top and side views of the embodiment of the invention shown in FIG. 3 with an outside view of the apparatus.

FIG. 6 illustrate front, top and side views of the embodiment of the invention shown in FIG. 3 with an outside view of the apparatus showing handle 119.

Figure 7:
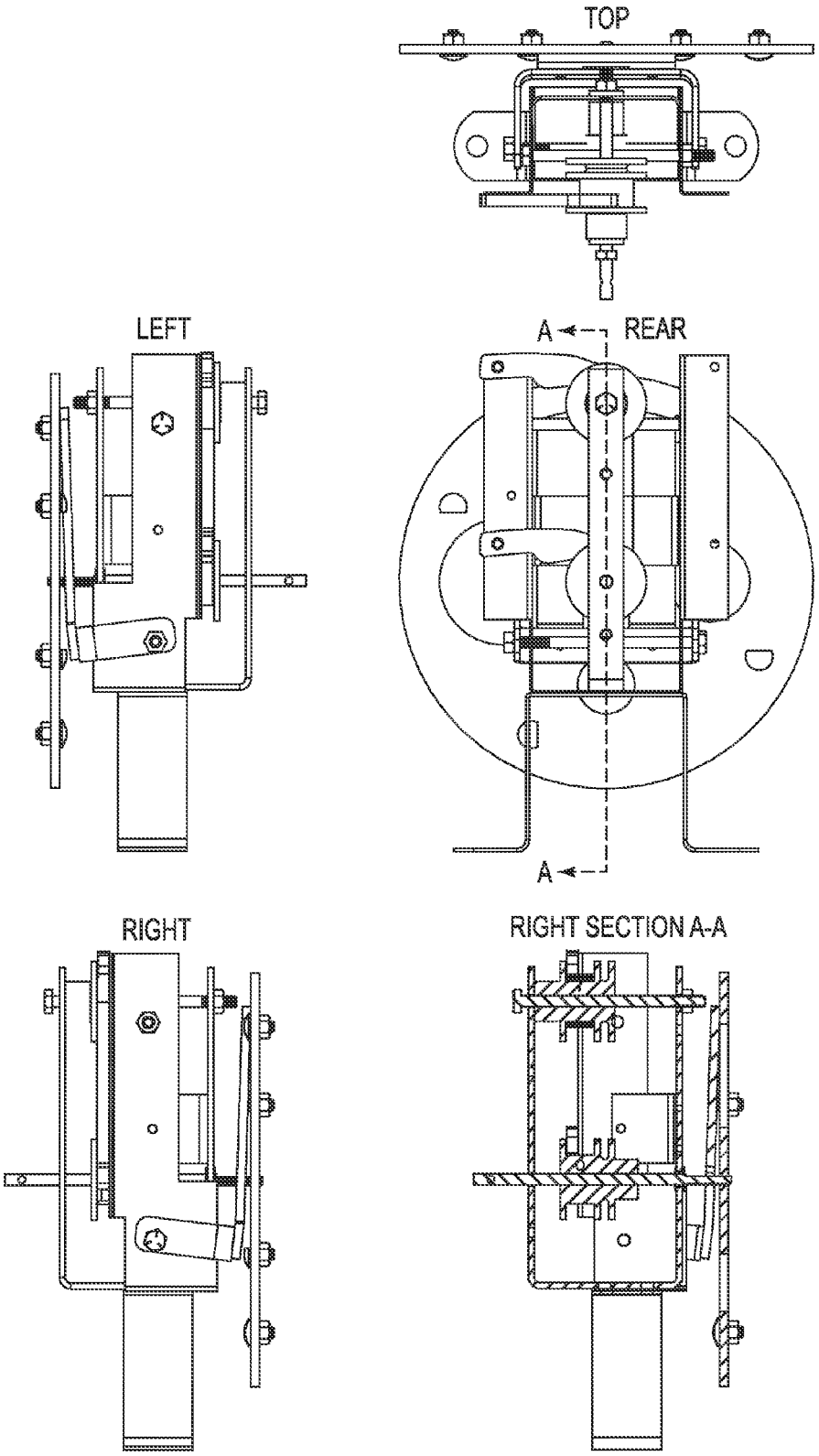
FIG. 7 illustrate left side, rear, top, and right side views of the rotary mechanism of the embodiment shown in FIG. 3.

FIG. 7 illustrate left side, rear, top, and right side views of the rotary mechanism of the embodiment shown in FIG. 3. The views are consistent with the views of the container in FIG. 6.

Figure 8:
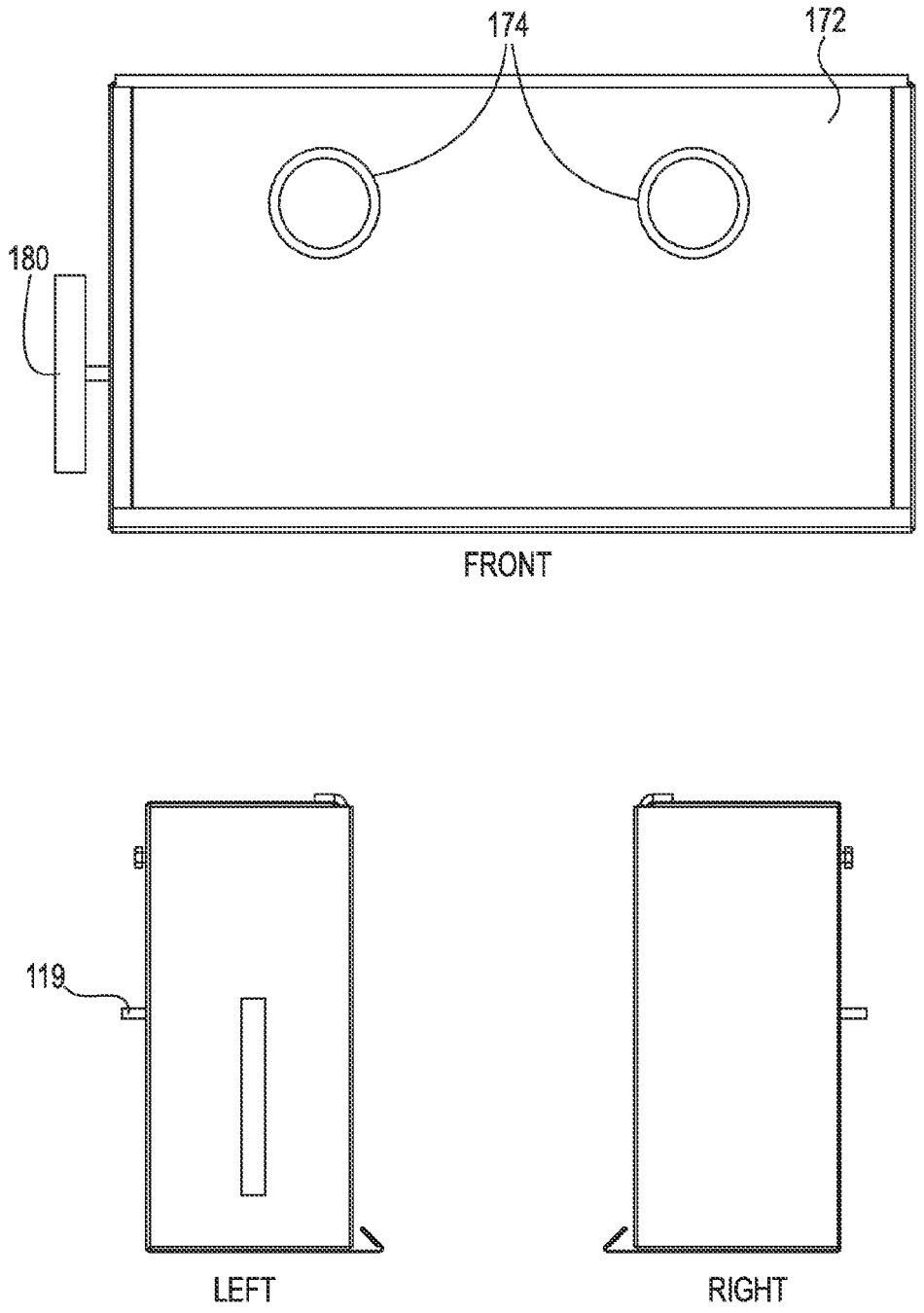
FIG. 8 illustrate left, front, and right views of another embodiment of the invention with two apertures on the front surface of a container.

FIG. 8 illustrate left, front, and right views of another embodiment of the invention with two apertures on front surface 172 of a container. No handle 119 is needed for this embodiment as the tension device is a rope reset (180) that resets tension for one revolution.

Figure 9:
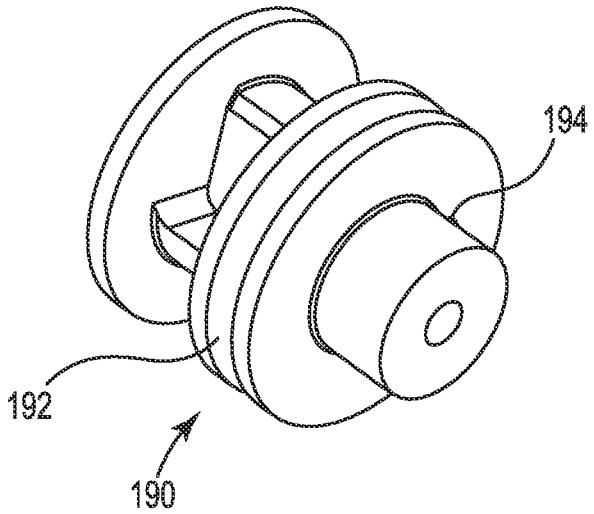
FIG. 9 illustrates a perspective view of another embodiment of the tension device, a pull cord mechanism that can rewind a rotary plate one revolution.

FIG. 9 illustrates a perspective view of another embodiment of the tension device, a pull cord spool mechanism (190) that can rewind a rotary plate one revolution as desired in the embodiment shown in FIG. 8. Shown is a rope winding opening (192 in the spool and a lower rope spool hole.

The method of using a portable rotary target apparatus comprises five steps. The first step is providing a portable rotary target apparatus that comprises at least one projectile actuated rotary target mechanism as described above and a container encompassing the at least one projectile actuated rotary target mechanism, the container comprising a front surface offset from the rotary plate to permit collection of spent projectiles and having an aperture sized to be at least as large as the largest aperture on the rotary plate and positioned over the first aperture of the rotary plate and the pressure-actuated plate. The second step is providing a projectile device having at least one projectile suitable for use with the apparatus. The third step is applying tension to the constant tension device and placing the apparatus at a desired location. The fourth step is impacting the visible portion of the pressure-actuated plate with the projectile. The fifth step is observing the rotation of the rotating plate from showing the first aperture of the rotary plate to showing the next aperture.

In some embodiments of the invention, the method further comprises three additional steps. The sixth step is impacting the visible portion of the pressure-actuated plate with the projectile. The seventh step is observing the rotation of the rotating plate from showing the current aperture of the rotary plate to showing the next aperture. The eighth step is repeating steps six and seven until a person firing the projectile device is finished shooting at the portable target apparatus.

In still another embodiment, the rotary plate contains at least three apertures of decreasing sizes and the method further comprises another step. The ninth step is monitoring the time taken to hit the visible face with all apertures in a predetermined of complete rotations of the rotary face.

Another embodiment of the method of the invention involves use of multiple embodiments of the projectile actuated rotary target mechanism. This method is similar to the method that comprises five steps except the apparatus that is provided is different and three additional steps are included. The portable rotary target apparatus comprises at least two projectile actuated rotary target mechanisms and a front surface offset from the rotary plate to permit collection of spent projectiles. The front surface also has an aperture associated with each projectile actuated rotary target mechanism, sized to be at least as large as the largest aperture on the rotary plate, and positioned over the first aperture of the rotary place and the pressure-actuated plate, and the rotary plate comprises at least three apertures and a fourth colored region where a fourth aperture would have been located. The apparatus also comprises a pull cord mechanism to reset all rotary plates to a position where the first aperture of each rotary plate is at a position showing the pressure-sensitive plate. Also provided for this method is a projectile device for each projectile actuated rotary target mechanism. This method further comprises three additional steps. The sixth step is impacting the visible portion of the second frontal face with the projectile. The seventh step is observing the rotation of the rotating plate from showing the current aperture of the rotary plate to showing the next aperture. The eighth step is repeating steps six and seven until the rotary plate for one projectile actuated rotary target mechanism displays a color region instead of an aperture.

Embodiments of the previous method further comprise two additional steps. The ninth step is pulling the pull cord to reset the original positions of all of the rotary plates. The tenth step is repeating steps four through eight.

Other modifications and changes made to fit particular operating requirements and environments will be apparent to those with ordinary skill in the art. Thus, the invention is not considered limited to the embodiments discussed for purposes of disclosure and covers all changes and modifications that do not constitute departures from the true spirit and scope of this invention.

The invention claimed is:

1. A portable rotary target apparatus, comprising: at least one projectile actuated rotary target mechanism, comprising: a rotary plate having a front face, a rear face, an axis of rotation with an axis rod, a first aperture having a size and displaced from the axis, at least a second aperture having a different size and displaced from the first aperture, and a stop associated with each aperture and located on the rear face, and the rotary plate is able to rotate along its axis rod about an axis perpendicular to the frontal face; a non-rotary, pressure-actuated plate, proximate to the rear face of the rotary plate, having a rear face and a frontal face with an edge configured to contact the stop associated with each aperture to stop further rotation of the rotary plate, and the pressure-actuated plate is made of a material configured to be resistant to penetration by impact of a projectile from a predetermined projectile device; and a portable frame in communication with the axis rod, anchoring one end of a constant tension device that has its other end in communication with the axis rod, and anchoring one end of a contacting device configured to have its other end in contact with the rear face of the pressure-actuated plate to urge the front face of the pressure-actuated plate to contact the rear face of the rotary plate; wherein, when the constant tension device is under tension and the pressure-actuated plate is pushed away from the rotary plate by an impact of a projectile, the rotary plate is able to rotate to the next stop and the aperture associated with that stop is now over the pressure-actuated plate.

2. The apparatus of claim 1, further comprising: a container encompassing the at least one projectile actuated rotary target mechanism and comprising a front surface offset from the rotary plate to permit collection of spent projectiles and having an aperture sized to be at least as large as the largest aperture on the rotary plate and positioned over the first aperture of the rotary plate and the pressure-actuated plate.

3. The apparatus of claim 2 wherein the container comprises materials durable under exposure to outdoor conditions and a collection region below the front surface configured to be able to gather spent projectiles.

4. The apparatus of claim 1 wherein the constant tension device is a windable spring.

5. The aperture of claim 1 wherein the rotary plate comprises at least three apertures having decreasing sizes.

6. The apparatus of claim 1 wherein the rotary plate in communication with the constant tension device is configured to make at least ten complete rotations about the axis rod before the tension device is de-energized.

7. The apparatus of claim 1 wherein the rotary plate in communication with the constant tension device is configured to make at least twenty complete rotations about the axis rod before the tension device is de-energized.

8. The apparatus of claim 1 wherein the rotary plate in communication with the constant tension device is configured to make at least thirty complete rotations about the axis rod before the tension device is de-energized.

9. The apparatus of claim 1 wherein the rotary plate in communication with the constant tension device is configured to make at least forty complete rotations about the axis rod before the tension device is de-energized.

10. The apparatus of claim 2, wherein the container further comprises a replaceable sheet in front of its front surface depicting a target display.

11. The apparatus of claim 1, wherein the contacting device is a torque latch.

12. The apparatus of claim 1, further comprising: a container encompassing at least two projectile actuated rotary target mechanisms and comprising a front surface offset from the rotary plate to permit collection of spent projectiles and having an aperture associated with each projectile actuated rotary target mechanism, sized to be at least as large as the largest aperture on the rotary plate, and positioned over the first aperture of the rotary plate and the pressure-actuated plate.

13. The apparatus of claim 12 wherein the container has a collection region below the front surface configured to be able to gather spent projectiles.

14. The apparatus of claim 12 wherein the rotary plate comprises at least three apertures and a fourth colored region where a fourth aperture would have been located, and a pull cord mechanism to reset all rotary plates to a position where the first aperture of each rotary plate is at a position showing the pressure-sensitive plate.

15. A method of using a portable rotary target apparatus, comprising the steps of: a. providing a portable rotary target apparatus, comprising: i. at least one projectile actuated rotary target mechanism, comprising: (a). a rotary plate having a front face, a rear face, an axis of rotation with an axis rod, a first aperture having a size and displaced from the axis, at least a second aperture having a different size and displaced from the first aperture, and a stop associated with each aperture and located on the rear face, and the rotary plate is able to rotate along its axis rod about an axis perpendicular to the frontal face; (b). a non-rotary, pressure-actuated plate, proximate to the rear face of the rotary plate, having a rear face and a frontal face with an edge configured to contact the stop associated with each aperture to stop further rotation of the rotary plate, and the pressure-actuated plate is made of a material configured to be resistant to penetration by impact of a projectile from a predetermined projectile device; and (c). a portable frame in communication with the axis rod, anchoring one end of a constant tension device that has its other end in communication with the axis rod, and anchoring one end of a contacting device configured to have its other end in contact with the rear face of the pressure-actuated plate to urge the front face of the pressure-actuated plate to contact the rear face of the rotary plate; and ii. a container encompassing the at least one projectile actuated rotary target mechanism and comprising a front surface offset from the rotary plate to permit collection of spent projectiles and having an aperture sized to be at least as large as the largest aperture on the rotary plate and positioned over the first aperture of the rotary plate and the pressure-actuated plate; b. providing a projectile device having at least one projectile suitable for use with the apparatus; c. applying tension to the constant tension device and placing the apparatus at a desired location, d. impacting the visible portion of the pressure-actuated plate with the projectile, e. observing the rotation of the rotating plate from showing the first aperture of the rotary plate to showing the next aperture.

16. The method of claim 15, further comprising the steps of:

f. impacting the visible portion of the pressure-actuated plate with the projectile, g. observing the rotation of the rotating plate from showing the current aperture of the rotary plate to showing the next aperture, h. repeating steps f and g until a person firing the projectile device is finished shooting at the portable target apparatus.

17. The method of claim 16 wherein the rotary plate containing at least three apertures of decreasing sizes and the method further comprises the step of:

i. monitoring the time taken to hit the visible face with all apertures in a predetermined number of complete rotations of the rotary face.

18. The method of claim 15 wherein the portable rotary target apparatus, comprises: at least two projectile actuated rotary target mechanisms and comprising a front surface offset from the rotary plate to permit collection of spent projectiles and having an aperture associated with each projectile actuated rotary target mechanism, sized to be at least as large as the largest aperture on the rotary plate, and positioned over the first aperture of the rotary plate and the pressure-actuated plate, and the rotary plate comprises at least three apertures and a fourth colored region where a fourth aperture would have been located, and a pull cord mechanism to reset all rotary plates to a position where the first aperture of each rotary plate is at a position showing the pressure-sensitive plate, and wherein there is a projectile device for each projectile actuated rotary target mechanism and the method further comprises the steps of: f. impacting the visible portion of the second frontal face with the projectile, g. observing the rotation of the rotating plate from showing the current aperture of the rotary plate to showing the next aperture, h. repeating steps f and g until the rotary plate for one projectile actuated rotary target mechanism displays a color region instead of an aperture.

19. The method of claim 18, further comprising the steps of:

i. pulling the pull cord to reset the original positions of all of the rotary plates and j. repeating steps d, e, f, g, and h.

* * * * *